United States Patent [19]

Rose

[11] Patent Number: 4,967,631

[45] Date of Patent: Nov. 6, 1990

[54] TREMOLO AND TUNING APPARATUS

[76] Inventor: Floyd D. Rose, 5303 154th Ave. SE., Bellevue, Wash. 98006

[21] Appl. No.: 402,784

[22] Filed: Sep. 5, 1989

[51] Int. Cl.[5] ..... G10D 3/14

[52] U.S. Cl. ..... 84/313

[58] Field of Search ..... 84/267 BT, 298, 312 R, 84/313

[56] References Cited

U.S. PATENT DOCUMENTS

| | | | |
|---|---|---|---|
| 4,171,661 | 10/1979 | Rose | 84/313 |
| 4,457,201 | 7/1984 | Storey | 84/313 |
| 4,497,236 | 2/1985 | Rose | 84/298 |
| 4,549,461 | 10/1985 | Rose | 84/313 |
| 4,608,904 | 9/1986 | Steinberger | 84/297 R X |
| 4,632,005 | 12/1986 | Steinberger | 84/313 |
| 4,638,711 | 1/1987 | Stroh | 84/313 |
| 4,674,389 | 6/1987 | Fender | 84/313 |
| 4,677,891 | 7/1987 | Gressett, Jr. et al. | 84/267 BT X |
| 4,681,011 | 7/1987 | Hoshino | 84/313 |
| 4,690,027 | 9/1987 | Ido | 84/313 X |
| 4,882,967 | 11/1989 | Rose | 84/313 |

OTHER PUBLICATIONS

Pages 70–71, 1988, Fernandes Co. Ltd., Brochure "FRT-7 Tremolo System".

Gotoh Gut Co., Ltd., drawing of GE-1988 Model Tremolo System.

*Primary Examiner*—Brian W. Brown

*Attorney, Agent, or Firm*—Lerner, David, Littenberg, Krumholz & Mentlik

[57] ABSTRACT

An improved tremolo and tuning apparatus for stringed musical instruments is disclosed which presents a relatively low profile when mounted on the stringed musical instrument, and yet possesses string locking and fine tuning capabilities. The tremolo and tuning apparatus includes a tremolo for simultaneously changing the pitch of all of the strings of the instrument, and which includes a base plate having a support surface. A rotatable string support block for each of the strings is rotatably mounted on the base plate so as to provide a string support area above the support surface of the tremolo. A string clamp is connected to each of the rotatable string support blocks for holding each of the strings relative to the rotatable string support block. A pivot arm is connected to each of the rotatable string support blocks and includes an extended portion which is at an elevation below the support surface of the base plate when the tremolo is mounted on the stringed musical instrument. Adjustment members are mounted on the tremolo and are engageable with the extended portions of the pivot arms for rotating the rotatable string support blocks and associated string clamps as a unit so as to fine tune the strings of the instrument.

60 Claims, 5 Drawing Sheets

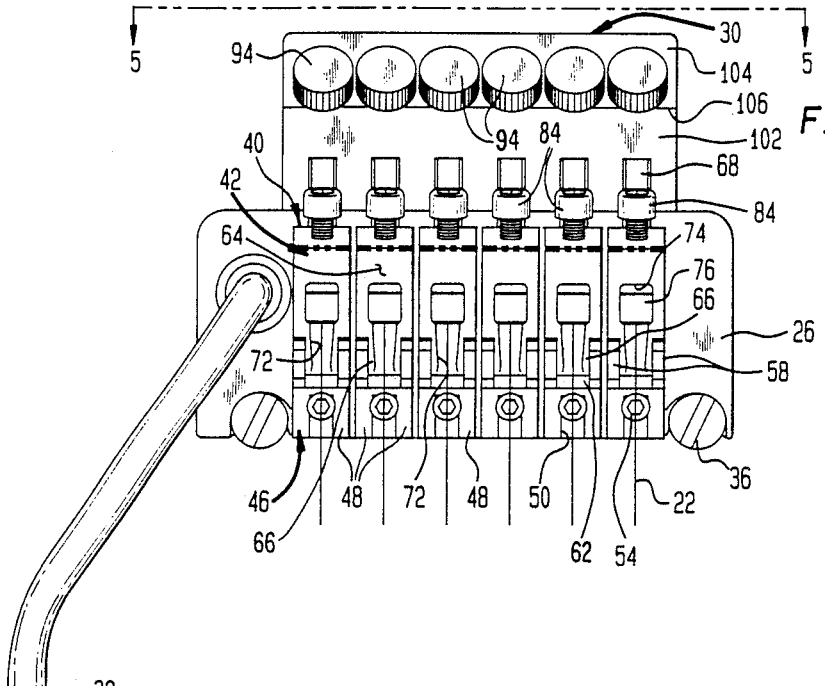
FIG. 4
FIG. 5
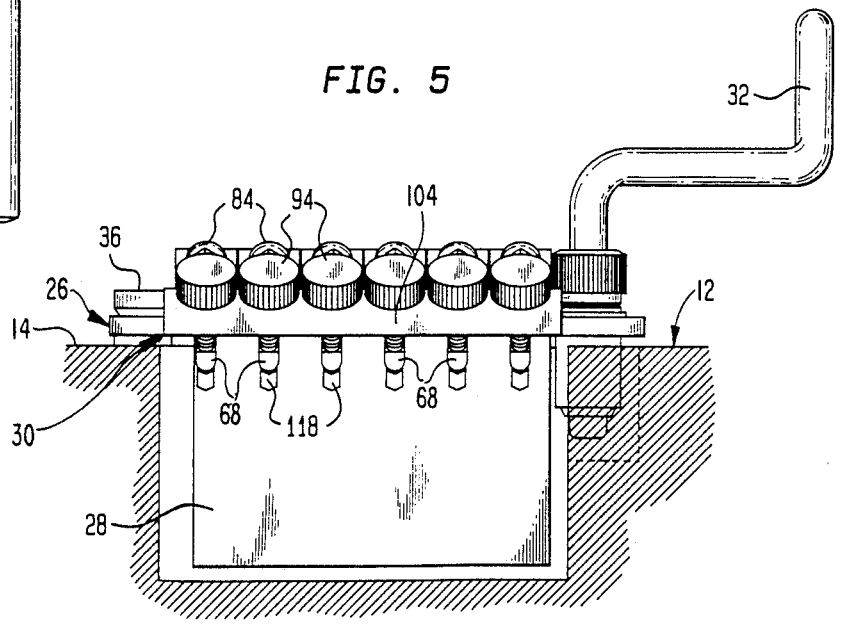

TREMOLO AND TUNING APPARATUS

FIELD OF THE INVENTION

The present invention relates to a tremolo and tuning apparatus for stringed musical instruments and, more particularly, to an improved tremolo and tuning apparatus which presents a relatively low profile when mounted on a stringed musical instrument and yet possesses string locking and fine tuning capabilities.

BACKGROUND OF THE INVENTION

As is known to those skilled in the art of stringed musical instruments, such as guitars, the strings of the instrument extend between two critical contact points, typically provided on or at the nut of the instrument and on or at the bridge of the instrument. Each of the strings also extends beyond at least one of the critical contact points where it is secured to a tuning peg or tuning machine provided on the instrument for adjusting the tension of the string. The other end of the string also generally extends beyond the other control contact point so as to be anchored to the instrument.

As is also known in the art, the sound produced by each of the strings is affected both by the string length between the critical contact points and by the tension on the string. Generally, the string length is adjusted by adjustment of the distance between the critical contact points at which the string contacts the bridge and nut elements of the instrument. This is generally referred to as harmonic or string length tuning. The tension of the strings of the musical instrument is generally adjusted by means of the tuning pegs or machines which serve to increase or decrease the tension of the strings. This latter type of adjustment is often referred to as pitch or fine tuning of the strings. Generally, each of the strings of a musical instrument may be both pitch and harmonically tuned individually and independently of the other strings of the musical instrument.

Tremolo devices for stringed musical instruments are also generally well-known and are typically used to simultaneously and significantly either reduce or increase the tension of all of the strings of the musical instruments to thereby produce unusual tone variations or special sound effects. Although the effects achievable with tremolo devices on guitars and the like were popularized in the 1960's, many musicians did not readily adopt and/or continue the use of tremolo devices due to problems of detuning of the strings of the guitars on which the tremolo devices were mounted and used. As a result of several inventions made by Floyd Rose, the inventor herein, in late 1970's and early 1980's, several of the problems associated with detuning of the strings of guitars employing tremolo devices were minimized.

More particularly, in accordance with one of the inventions of Floyd Rose, which is the subject of Rose's U.S. Pat. No. 4,171,661 issued Oct. 23, 1979, the bridge of the musical instrument is provided on the tremolo device and the strings are held or "locked" at or in the vicinity of both the bridge and the nut of the instrument so as to be restrained against relative sliding movement during activation and return of the tremolo device. In this manner, after the tremolo is used and then returned to an inactive position, the strings essentially return to the same tension as before activation and, therefore, remain in tune. In the preferred embodiment disclosed in the '661 patent, the strings of the instrument are clamped at both the nut of the guitar and at the bridge of the guitar, with the clamping bridge elements being mounted on and movable with the tremolo device. This invention of Floyd Rose is sometimes referred to as his "string locking" invention.

Two further significant improvements of Floyd Rose in tremolo devices are embodied in U.S. Pat. No. 4,497,236 (and its continuation, U.S. Pat. No. 4,549,461). One of the improvements resides in the provision of fine tuning means mounted on and movable with the tremolo device for fine tuning of the strings essentially without changing the harmonic tuning thereof. The second improvement resides in a particular type of fine tuning means in which the string support means (which includes the bridge of the instrument) and the string holding means (which hold the strings) are moved substantially as a unit to effect fine tuning of the strings individually without changing the harmonic tuning thereof. This latter improvement thus permits fine tuning of the strings as well as employment of the first Floyd Rose invention which is the subject of the '661 patent in that movement of the strings relative to the bridge of the instrument is minimized.

In the particular embodiment disclosed in the '236 patent, which employs both of the aforenoted improvements, individual bridge elements are provided for each of the strings of the instrument. Each of the bridge elements is of a two-piece construction and includes a first forward block element and a second rear block element which is rotatably mounted to the first block and which includes a string contact surface thereon. Each forward block element is mounted for sliding movement on the base plate of the tremolo device for adjusting or changing the harmonic tuning of its respective string. Each rear, rotatable block element includes a clamping block for clamping the string against the string contact surface. The clamping block is urged against the string by means of a threaded shank or rod which extends rearwardly of the rear block element through a suitable slot provided in an upwardly extending flange of the tremolo device. Fine tuning adjustment screws are mounted to the flange of the tremolo device and are positioned so as to contact the extended portion of the threaded shank or rod to thereby adjust the rotatable position of the rear block. This, in turn, adjusts the tension of the string held thereby, essentially without changing the harmonic tuning of the strings, since the distance between the critical contact point on the nut and the critical contact point on the bridge (provided on the forward portion of the string contact surface of the rear block element) essentially remains the same.

The tremolo and tuning apparatus in accordance with the Floyd Rose inventions have enjoyed huge commercial success, the inventions of such patents having been licensed throughout the electric guitar industry. As a result, numerous variations of tremolo and tuning apparatus employing the inventions of the Floyd Rose '661 and '236 patents have been developed in an effort to provide an optimum tremolo and tuning apparatus. Among several of the improvements and/or variations have been tremolo and tuning apparatus in which attempts have been made to decrease the profile of the tremolo apparatus by decreasing the height or elevation of the flange on which the fine tuning adjustment members are mounted. Thus, tremolo bridge systems have heretofore been developed having angled, rearwardly-directed flanges which extend obliquely relative to the surface of the tremolo base plate and which have a downwardly extending portion on which the fine tuning adjustment members are mounted so that the adjustment members move in a direction generally oblique to the surface of the tremolo base plate, as opposed to perpendicularly thereto as shown in the embodiment of the '236 patent. In another variation of a tremolo bridge system, a camming-type mechanism is utilized in which the rearwardly-extending shanks of the rotatable block elements are provided with a rotatable sleeve that engages against a sloped surface of the rear flange of the tremolo device. By rotation of the sleeve, the rotational position of the rotatable block element is adjusted to adjust the tension of the string held thereby. In each of these variations of prior tremolo bridge systems, however, the rearwardly-extending members connected to the rotatable bridge elements are arranged or positioned at an elevation above the surface of the tremolo base plate and thus, there is still provided a relatively high profile, as well as a relatively complicated, awkward adjustment procedure.

Here it should be noted that tremolo bridge systems for guitars having relatively low profiles are desired by musicians in order to be more comfortable and, also, to make it less likely for musicians to accidentally and/or inadvertently detune the strings as the result of resting a hand on the rearwardly-extending flange of the tremolo device. At the same time, it is desired to still provide string locking and fine tuning capabilities in order to permit utilization of the Floyd Rose improvements which are the subject of the '661 and '236 patents. Also, low profiles are desired in order to permit musicians, if desired, to pick or play the strings closer to the bridge contact points of the instrument. With the tremolo bridge systems having profiles in which the rearward flange containing the fine tuning adjustment members are located at a significant distance above the height of the strings, it often is difficult to "pick" the strings close to the bridge contact points. Accordingly, the search has continued for further improvements in an effort to optimize tremolo and tuning apparatus for musical instruments.

SUMMARY OF THE INVENTION

According to the present invention, there is provided an improved tremolo and tuning apparatus which employs string locking and fine tuning capabilities and which, due to the nature and arrangement of its components, is capable of providing a relatively low profile. As such, the tremolo and tuning apparatus of the present invention constitutes a further step toward an optimum tremolo and tuning apparatus for stringed musical instruments.

The tremolo and tuning apparatus of the present invention is for use with stringed musical instruments of the type in which the strings make a first critical contact with the instrument at a point on the nut of the instrument and a second critical contact at a point on the bridge of the instrument. The tremolo and tuning apparatus includes tremolo means which is adapted to be mounted on the stringed musical instrument for simultaneously changing the pitch of all of the strings of the instrument, the tremolo means including a base plate having a support surface. String support means for each of the strings are provided which are each rotatably mounted on the base plate and provide a string support area above the support surface of the tremolo means. String holding means are connected to each of the string support means for holding each of the strings relative to its respective string support means. Fine tuning means associated with each of the string support means are provided for adjusting the tension of the string held by the string holding means by rotating the string support means and string holding means as a unit so as to fine tune the strings essentially without changing the distance between the first and second critical contact points of the string. Each of the fine tuning means in accordance with the present invention include a pivot member or arm connected to the string support means and having an extended portion which is at an elevation below the support surface of the base plate when the tremolo means is mounted on the stringed musical instrument, and adjustment means mounted on the tremolo means engageable with the extended portion of the pivot arm for rotating the string support means.

With such a tremolo and tuning apparatus, it is possible to provide a relatively low profile for the apparatus in which the adjustment means mounted on the tremolo means is at substantially the same elevation as the height of the strings. This is possible by virtue of the fact that the pivot arm connected to the rotatable string support means includes a portion which is disposed below the support surface on which the string support means are mounted, such that the adjustment means may likewise be provided at a much lower elevation relative to the support surface for the string support means. At the same time, locking or holding of the strings on the bridge and fine tuning capabilities are provided with the tremolo and tuning apparatus of the present invention. As noted above, a relatively low profile is advantageous and desired for providing increased comfort for the musicians by insuring that there is minimal interference during play with the fine tuning adjustment members on the flange of the tremolo device as in prior art apparatus. A low profile also minimizes the likelihood of the musician accidentally turning the fine tuning adjustment members, as a result of resting his hand on the rearwardly-extending fine tuning flange which would thus detune the strings. Additionally, with a low profile, the musician can "pick" much closer to the bridge contact point for the strings, which some players prefer because it produces pleasing tone changes.

In accordance with a preferred embodiment of the present invention, the extended portions of the pivot arms (i.e., the portions which are to be contacted by the adjustment members) are disposed at an elevation below the bottom surface of the base plate of the tremolo means. This may be accomplished by pivot arms which comprise providing a downwardly directed portion of the pivot arms arranged to pass through slots in the tremolo means which are disposed rearwardly of the string support means and a rearward, longitudinally-extending portion which includes the extended portion engageable by the adjustment means.

In accordance with a further aspect of the present invention, the tremolo means includes a fine tuning support member extending from the base plate of the tremolo means rearwardly of the string support means and on which the adjustment means for fine tuning of the strings are supported. In a preferred embodiment, the fine tuning support member comprises a substantially triangular-shaped support flange having a bottom surface generally parallel to the support surface of the base plate, a forward inclined top surface and a rearward inclined top surface, and the adjustment means comprise adjustment elements supported on the substantially triangular-shaped support flange so as to extend through the rearward inclined top surface and the bottom surface of the support flange. Advantageously, the inclined surfaces of the triangular-shaped support flange define a top ridge which is substantially at or below the elevation of the top surfaces of the support means, i.e., at approximately the elevation at which the strings are supported. The triangular-shaped fine tuning support flange is more substantial and rigid than in prior art arrangements, thus presenting an aesthetically pleasing appearance as well as a functionally superior support flange in which the tendency to bend or move is minimized.

In accordance with a still further aspect of the present invention, lateral movement of the rearwardly extending pivot arms, and thus, the string support means, is minimized through the employment of spring means which urge the pivot arms upwardly toward the support flange and which include means for maintaining the lateral position of the pivot arms relative to the base plate. In a preferred embodiment, the spring means includes spring elements for each of the pivot arms which include concave sections for receiving and engaging lateral side portions of the rearwardly-extending pivot arms. Further still, the string holding means for holding of the strings relative to the string support means comprise clamping means which are separate and apart from the pivot arms. With this aspect of the present invention, the pivot arms may be such as to not serve any purpose other than pivoting of the string support means, which therefore enables maximization of the desired function of such pivot arms. Likewise, the function of the clamping means may be maximized since it is not required to serve a dual function. As such, this aspect of the present invention is in contrast to the arrangement shown in the '236 patent in which the string clamping rods are extended to serve as a means to be contacted by fine tuning screws for rotating the string support and string holding means to fine tune the strings.

These and other features and characteristics of the present invention will be apparent from the following detailed description of a preferred embodiment which should be read in light of the accompanying drawings in which corresponding reference numerals refer to corresponding parts throughout the several views.

BRIEF DESCRIPTION OF THE DRAWINGS

FIG. 4 is a top plan view of the tremolo and tuning apparatus of FIG. 1, shown as mounted on an electric guitar, and again with parts omitted and parts broken away for clarity.

FIG. 5 is a rear elevational view of the tremolo and tuning apparatus of the present invention, taken along lines 5—5 of FIG. 4.

DETAILED DESCRIPTION OF THE PREFERRED EMBODIMENT

Figure 1:
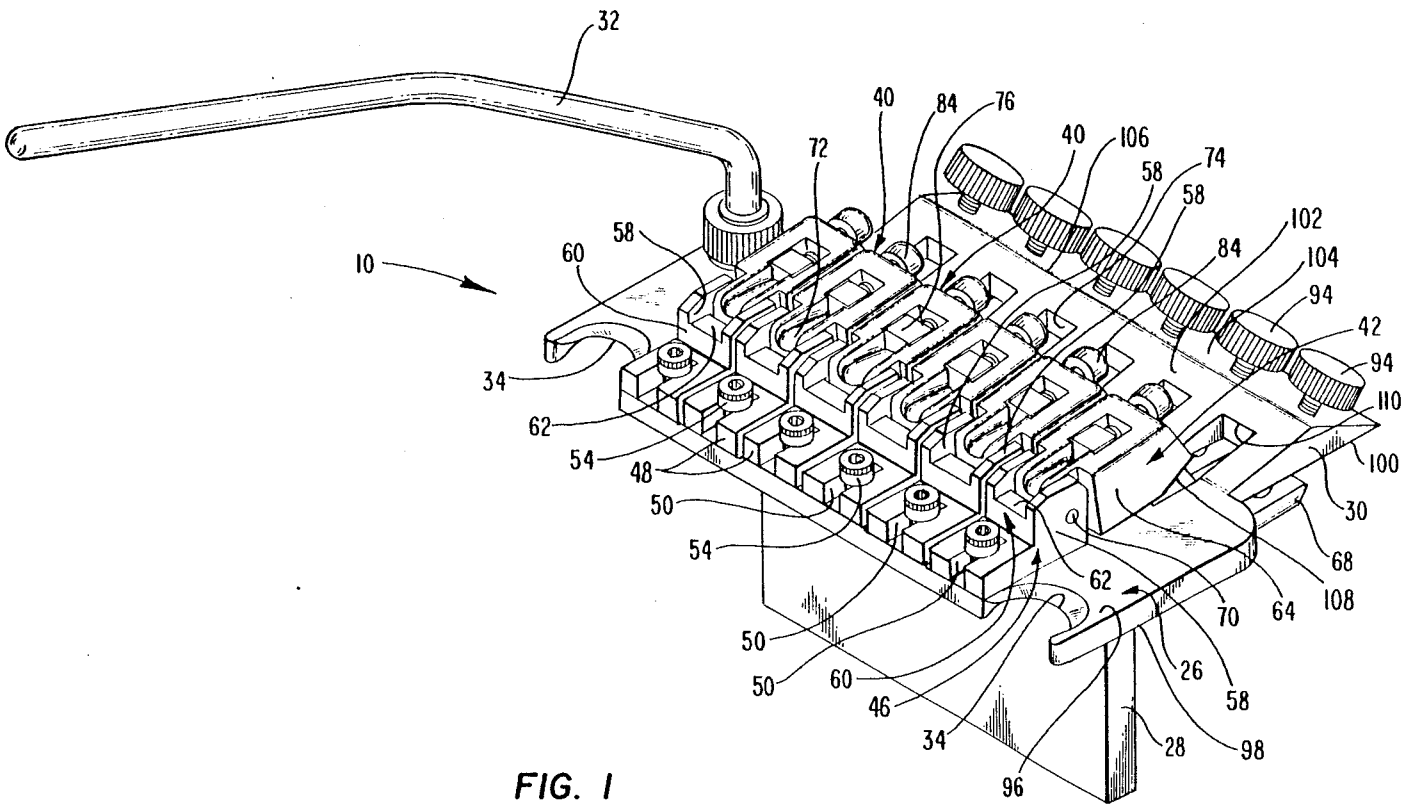
FIG. 1 is an enlarged perspective view of the tremolo and tuning apparatus of the present invention.
Figure 2:
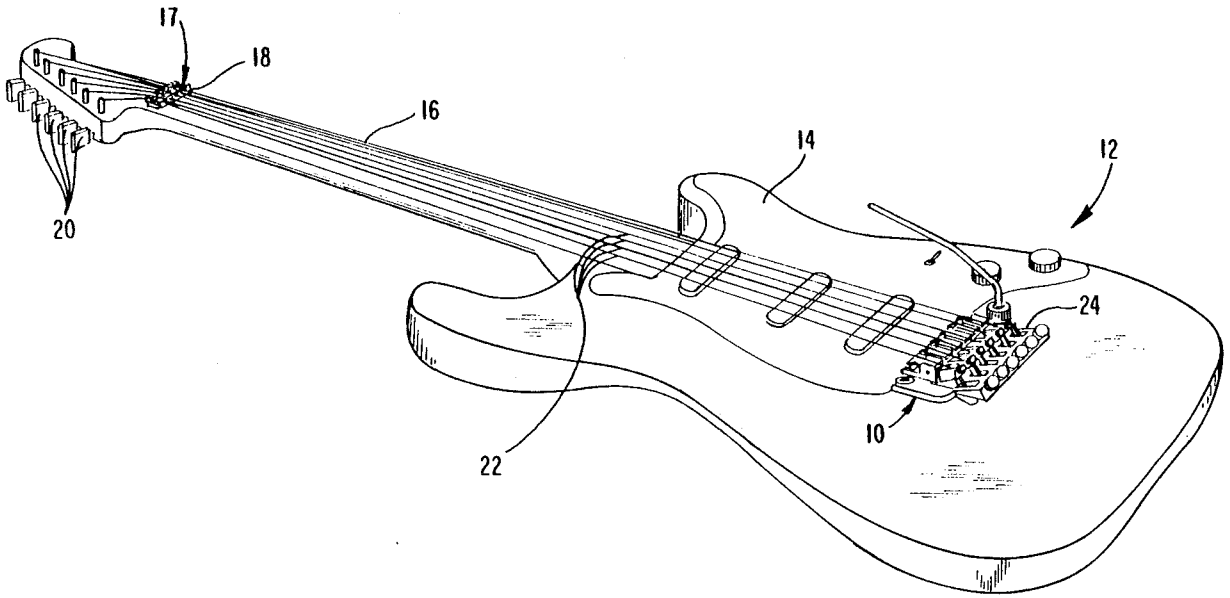
FIG. 2 is a perspective view of an electric guitar-type of stringed musical instrument on which the tremolo and tuning apparatus of FIG. 1 is mounted.

Referring now to the drawings wherein like reference characters represent like elements, FIG. 1 shows a preferred embodiment of the tremolo and tuning apparatus 10 in accordance with the present invention, and FIG. 2 shows such tremolo and tuning apparatus 10 mounted on an electric guitar 12. The guitar 12 comprises generally a body 14 and a neck 16. Near the top of the neck 16 is a nut element 18, and beyond the nut 18, there are provided several tuning pegs or machines 20, one for each string 22 of the guitar 12. On the body 14 of the guitar 12 is a bridge element, generally designated 24. The tuning and tremolo apparatus 10 in accordance with the present invention incorporates the function of the bridge element 24 of the guitar 12 as well as a tremolo apparatus for simultaneously and significantly increasing and/or decreasing the tension on all of the strings 22 of the guitar 12 to produce unusual tone variations or sound effects. In this regard, a string clamping device 17 is provided in the vicinity of the nut 18 for securely holding or restraining the strings against movement relative to the nut 18.

Although the present invention is shown in use on an electric guitar 12, it should be understood that the invention can be used on other stringed musical instruments, including, for example, banjos, ukuleles, mandolins, lutes, violins, cellos and even pianos. The invention will probably have its greatest use, however, on a guitar and, hence, it is so described herein. Further, although the present invention is described and shown as a bridge element, it should be understood that the invention could be adapted for use as the nut element of a stringed musical instrument as well.

As is well-known, each of the strings 22 of the guitar 12 make contact with the guitar 12 at the nut 18 and at the bridge 24, with the distance between the last contact point of the string 22 on the nut 18 (i.e., the contact point nearest the bridge 24) and the first contact point on the bridge 24 (i.e., the contact point nearest the nut 18) defining the effective vibratory length of the string during play. The contact points defining the effective vibratory string length may thus be referred to as the "critical" contact points for each string 22. As is also well-known, guitar strings 22 are both harmonically tuned and pitch tuned. Harmonic tuning of the strings 22 is accomplished by adjusting the distance between the critical contact points provided on the nut 18 and on the bridge 24 of the guitar 12. For example, harmonic tuning may be accomplished by moving the critical contact point of the string 22 on the bridge 24 longitudinally relative to the critical contact point on the nut 18. Pitch tuning of the strings 22 is accomplished by changing the tension of the strings 22. Ideally, this should be accomplished without changing the distance between the nut and bridge critical contact points. Increasing the tension of the strings 22 raises the pitch of the string 22 while decreasing the string's tension lowers the string's pitch. Pitch tuning is generally accomplished through use of the tuning pegs or tuning machines 20 on the head of the guitar 12, and/or through use of fine tuning adjustment members on the tremolo and tuning apparatus 10, as described more fully hereinbelow.

The tremolo and tuning apparatus 10 in accordance with the present invention employs generally the subject matter of U.S. Pat. Nos. 4,171,661 and 4,497,236, which patents are hereby incorporated by reference. As shown in more detail with reference to FIGS. 1 and 3–5, the particular tremolo device 10 in accordance with the present invention comprises generally a tremolo base plate 26, a depending flange 28 extending downwardly from the base plate 26, and a rearwardly directed fine tuning support member 30. The tremolo device 10 also includes a tremolo bar 32 secured to the base plate 26 near one of the side edges thereof.

The base plate 26 is provided with knife-edge sections 34 adjacent each of the forward side corners of the tremolo device 10. The tremolo device 10 is adapted to be mounted on the guitar 12 by means of upstanding position screws 36 which are fixed to the body 14 of the guitar 12 and which have tapered grooves for receiving the knife edge sections 34 on the tremolo device 10 so that the base plate 26 is generally aligned parallel to the top surface of the guitar 12 (see FIG. 3). In this regard, the depending flange 28 extends downwardly to a cavity in the body 14 of the guitar 12 and has a horizontal spring or springs 38 connected to the bottom thereof to balance the tremolo device 10 against the action of the strings 22 which are secured to the tremolo device 10, as described more fully below.

In this manner, when the tremolo bar 32 is moved toward the body 14 of the guitar 12, the tremolo base plate 26 pivots or tilts upwardly above the two fixed position screws 36, against the action of the springs 38. This action significantly changes the original pitch tune of the strings 22, in a flat direction by virtue of the tension in the strings 22 being reduced, and facilitates an increased range of sounds for the instrument 12. When the original pitch tune is again desired, tremolo bar 32 is released and the springs 38 return the tremolo base plate 26 to its original position, which returns the bridge structure 24 and strings 22 to their original position. Similarly, when the tremolo bar 32 is moved away from the body 14 of the guitar 12, the base plate 26 pivots or tilts downwardly about the two fixed-position screws 36, increasing the tension of the guitar strings 22 and, thus, changing the original pitch in a sharp direction. When the tremolo bar 32 is again released, the increased tension on the strings 22 returns the tremolo base plate 26 to its original neutral position, returning the bridge structure 24 and strings 22 to their original position.

On the base plate 26 of the tremolo device 10, there are provided individual bridge elements 40 for each of the strings 22 of the guitar 12. As best seen with reference to FIGS. 6–7, the bridge elements 40 each include a rotatable string support member 42 which provides a string support area (generally 78, 80, 82) for the strings 22 and which, in the preferred embodiment, is mounted for rotation about an axis which extends transversely of the longitudinal direction of the strings 22. More particularly, in the preferred embodiment, the bridge elements 40 are each of a two-piece construction comprised of a first forward block element 46 and a second rear block element 42. The second rear block element 42, which serves as the rotatable string support member and has the string support area thereon, is rotatably mounted to the forward block element 46.

The forward block element 46 includes a front plate-like section 48 which has a slot 50 therein that extends rearwardly from the front edge thereof to approximately a point which is mid-width thereof. The slot 50 is wide enough to accommodate a machine screw or other securing device 54 which is threaded into the base plate 26 of the tremolo device 10 and which clamps the forward block element 46 against the plate 26 (see FIGS. 1, 4). Loosening of the machine screw 54 permits longitudinal movement of the forward block element 46 (together with its rear block element 42 and associated parts) for harmonic tuning of its respective string 22, as will be apparent from the description more fully hereinbelow.

The rear section of the forward block element 46 extends above the front plate-like section 48, but includes a cutout so that it is generally U-shaped when viewed from above and open in the rearward direction. The rear section thus comprises two side portions 58 joined at their forward ends by an intermediate portion 60. The top edge of the intermediate portion 60 is slightly relieved as shown at 62.

The rear block element 42 has a body portion 64 which is generally of the same width as the forward block element 46, a forward ear portion 66 which is adapted to be rotatably coupled to the front block element 46 and a pivot member or arm 68 which extends downwardly and rearwardly of the body portion 64. The forward ear portion 66 is approximately of the same width as the distance between the two side portions 58 of the rear section of the forward block element 46 and is adapted to be disposed therebetween. Aligned circular openings are provided through the two side portions 58 as well as the ear portion 66 of the rear block element 42, and a pin 70 is positioned in such openings so that the rear block element 42 is rotatable relative to the forward block element 46 about the pin 70. In this regard, it will be appreciated that the pin 70 extends generally perpendicular of the longitudinal direction of the strings 22.

The forward ear portion 66 includes a central generally longitudinally-extending recessed trough 72. The body portion 64 of the rear block element 42 includes a central recess 74 therein open onto the top surface for receiving a string clamp block 76. The forward portion of the central recess 74 is adjacent the rear portion of the recessed trough 72, and extends downwardly and slightly rearward. The recessed trough 72 and central recess 74 provide a string contact support area 78, 80, 82 which, in the preferred embodiment, is substantially continuous from the point at which the string 22 contacts it and the point at which the string 22 is clamped.

Figure 7:
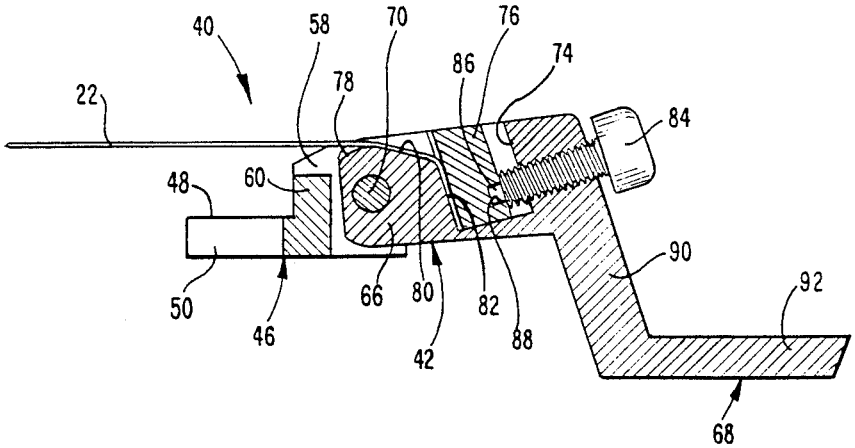
FIG. 7 is a side sectional view taken along lines 7—7 of FIG. 6.

As best seen in FIG. 7, the string contact or support area includes a forward string support portion 78 which includes the bridge critical contact point for the string 22, a rearwardly sloping transition portion 80, and a downwardly inclined string clamping portion 82. The forward string support portion 78 is curved and provides the initial or forwardmost contact of the bridge element 40 with the string 22. It will be appreciated that as the rear block element 42 is rotated (for purposes of fine tuning the string 22 as more fully described below), the point at which the string 22 makes its initial contact with the forward string support portion 78 will change or shift on the rear block element 42; however, the distance between this point of initial contact (which corresponds to the bridge critical contact point) and the critical contact point on the nut 18 of the guitar 12 will remain essentially unchanged. In this regard, the radius of curvature of the forward string support portion 78 preferably is approximately equal to the distance from the forward string support portion 78 to the axis of rotation of the rear block element 42. Further, the forward string support portion preferably extends over a sufficient distance to provide a desired range of fine tuning, for instance, over an arc of from about 30° to about 60°. Of course, the radius of curvature of the forward string support portion 78 and the distance it extends could be larger or smaller.

In the preferred embodiment, the rearwardly sloping transition portion 80 and the downwardly inclined string clamping portion 82 are arranged relative to one another so as to define an interior angle therebetween of greater than 90° and, more preferably, an angle of approximately 110° to approximately 140°. For example, in the particular embodiment shown in the figures, the rearwardly sloping transition portion is disposed at an angle of approximately 20° to the horizontal and the downwardly-inclined string clamping portion 82 is at an angle of approximately 15° to the vertical. This arrangement of the transition portion 80 and string clamping portion 82 is important in order to prevent overbending and possible breaking of a string 22 when same is secured to the bridge elements 40.

As noted above, the central recess 74 includes a clamp block 76 arranged therein which is adapted to be urged toward the downwardly inclined string clamping portion or surface 82 for clamping the string 22 between the second downwardly inclined surface 82 and the forward surface of the clamp block 76. In this regard, a clamping screw 84 is threadedly provided in the rear sloping surface of the body portion 64 and extends into the recess 74. The clamping screw 84 has a tip 86 of reduced dimension which is received in a recess or indentation 88 provided in the rear surface of the clamp block 76. Rotation of the clamping screw 84 thus urges the block 76, which rests on the bottom surface of the recess 74, toward the downwardly inclined string clamping surface 82. It will be appreciated from FIG. 7 that the rear surface of the body portion 64 of the rear block element 42 is inclined at an angle substantially matching the angle of the downward inclined string clamping surface 82 so that the clamping screw 84 extends perpendicularly from the rear surface. In the preferred embodiment, this angle of inclination is approximately 15° to the vertical.

Figure 6:
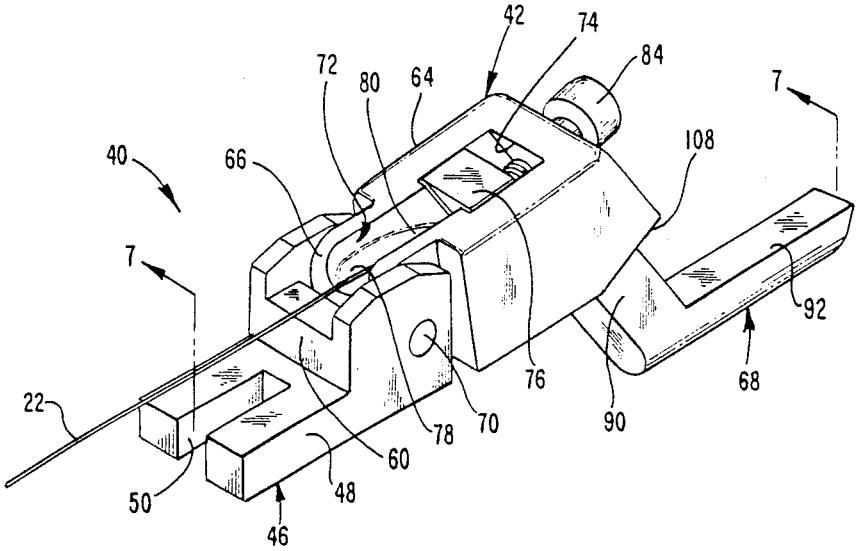
FIG. 6 is a perspective view of a bridge element employed in a preferred embodiment of the tremolo and tuning apparatus of the present invention, and also showing a string held thereby.

As can be seen from FIGS. 6 and 7, in order to clamp a string 22 to the rear block element 42, the clamp screw 84 is first loosened and the end of the string (from which any ball or other enlarged head provided on the string has been cut or removed) is then urged downwardly between the clamp block 76 and the downwardly-inclined surface 82 against the bottom of the recess 74. The clamp screw 84 is then tightened, and the string 22 is then arranged in the trough 72 so as to rest against the rearwardly sloping transition surface 80 and forward string support surface 78, and then passed forwardly over the neck 16 of the guitar 12 and threaded into the conventional tuning pegs or machines 20. As noted above, the string contact point on the bridge element 40 is provided on the forward string support portion 78 at the point where the string 22 leaves its contact with the trough 72. The string will then be both harmonic and pitch tuned as described more fully hereinbelow.

Figure 3:
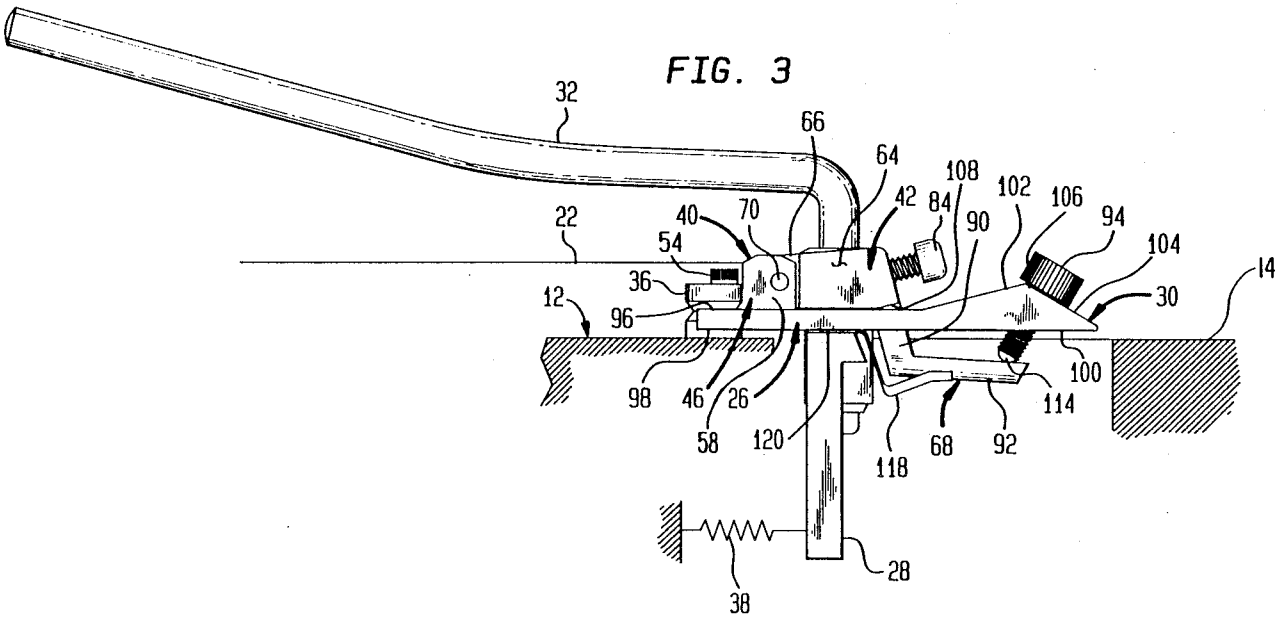
FIG. 3 is a side elevational view of the tremolo and tuning apparatus of FIG. 1 shown as mounted on an electric guitar, and with parts omitted and parts broken away for clarity.

As can best be seen from FIGS. 3 and 6–7, the pivot arm 68 of the rear block member 42 includes a downwardly-extending portion or leg 90 and a rearwardly-extending portion or leg 92. In the preferred embodiment, the pivot arm 68 is integrally formed with the body portion 64 of the rear block element 42 and has a width which is approximately equal to or slightly less than one-half the width of the body portion 64. Also, although pivot member 68 is centrally disposed on the rear block element 42 in the preferred embodiment, the pivot arm 68 could be disposed adjacent to one of the side edges of the body portion 64 of the block element 42 if desired to permit ease in manufacture. The downwardly-extending leg 90 of the pivot arm 68 serves to position the rearwardly extending leg 92 (which is to be acted upon by the fine tuning adjustment members 94 as described more fully hereinbelow) at a position below the top surface 96 of the base plate 26 and, more preferably, below the bottom surface 98 thereof. This thus enables pivoting of the rotatable block element 42 for fine tuning to be effected from a location below the surface of the base plate 26 on which the bridge elements 40 are positioned, and thus enable the fine tuning adjustment members 94 supported on the fine tuning support flange 30 to be arranged at a lower elevation and thereby provide a lower profile for the overall tremolo and tuning apparatus 10.

As best seen in FIGS. 1 and 3, the fine tuning support flange 30 is substantially triangularly-shaped in cross-section, having a bottom surface 100 aligned with the bottom surface 98 of the base plate 26, and a forward inclined top surface 102 and rearward inclined top surface 104 which meet an apex 106. As best seen in FIG. 3, the apex 106 of the support flange 30 is located at an elevation substantially corresponding to the elevation of the pivot pins 70 about which the rear block elements 42 rotate and, as such, below the top surface of the rearward block element 42. Also, as best seen in FIGS. 1 and 4, the rearward portion of the base plate 26 and the forward portion of the support flange 30 include a plurality of slots 110 aligned with the central portions of each of the rearward block elements 42 and through which the pivot arms 68 pass so that the rearward extending legs 92 lie beneath the bottom surface 100 of the support flange 30. Here it will be appreciated that if the pivot arms 68 are disposed adjacent one side edge of the rearward block elements 42, the slots 110 in the base plate 26 and support flange 30 would likewise be shifted laterally so as to be aligned with the side edge of each of the rearward block elements 42.

A plurality of threaded bores are provided in the support flange 30 for receiving a plurality of threaded fine tuning adjustment members or screws 94. The threaded bores are aligned with the slots 110 and extend from the rearward inclined surface 104 through the support flange 30 to the bottom surface 100. As best seen in FIG. 3, the end 114 of each of the fine tuning adjustment screws 94 extends beneath the bottom surface 100 to engage the top surface of the rearwardly-extending leg 92 of the corresponding pivot arm 68 in alignment therewith. In this regard, the ends 114 of each of the fine tuning adjustment screws 94 are provided with a suitable radius (as opposed to being threaded) so as to smoothly engage the rearwardly-extending legs 92 of the pivot arms 68 and slide therealong during adjustment of the tension on the strings 22.

As can best be seen in FIG. 3, the fine tuning adjustment screws 94 are oriented at an angle which is substantially normal to the rearward inclined surface 104 of the flange 30, and located toward the apex 106. Preferably, the fine tuning adjustment screws are oriented at an angle of about 45° to about 90° relative to the top surface 96 of the base plate 26, and more preferably at an angle of about 50° to about 70°. Thus, the rear surface 104 preferably is inclined at an angle of about 20° to about 40° to the horizontal. The forward surface 102 is inclined at an angle generally corresponding to the slope of the surface 108 at the rear of the rear block element 42. This is desirable so that there will thus be minimal interference between the rear block element 42 and the flange 30 if the bridge elements 40 are moved to a rearward position in adjusting the harmonic tuning of the strings 22. In other words, the bridge elements 40 may be moved rearwardly to an extent such that the rear edge of the rear block element 42 lies over the forward inclined surface 102. Preferably, the forward inclined surface 102 is inclined at an angle of approximately 10° to about 30°.

In the preferred embodiment, and as best seen in FIGS. 3 and 5, the tremolo device 10 is also provided with spring means 118 for urging each of the pivot arms 68 upwardly against its respective fine tuning adjustment screws 94. The spring means, in the preferred embodiment, comprises a plurality of individual leaf spring members or fingers 118 extend from a common web 120 which is supported between the bottom surface 98 of the base plate 26 and the downwardly-extending flange 28 of the tremolo device 10, with each of the fingers 118 including a downward sloped section and an upwardly angled section adapted to engage the bottom of its respective pivot member 68. In this regard, the spring members 118 each include a concave portion (see FIG. 5) which is adapted to engage lateral side portions of the pivot arms 68 so as to ensure that the pivot arms 68 are maintained in a desired lateral position and in alignment with the fine tuning adjustment screws 94. As the pivot arms 68 are integral with the rear block elements 42 which hold the ends of the strings 22, the spring members 118 also serve to maintain the rear block 42 in the desired lateral position, thus maintaining the proper lateral position of the strings 22. In this manner, possible detuning of the strings as the result of very slight changes in string tension due to any lateral misalignment is minimized. In the preferred embodiment, the pivot arms 68 include a rounded lower surface suitable for being received within the concave surface of the spring members 118. It will be appreciated, however, that the lower portion of the pivot arms 68 could have another shape, such as a V-shaped cross-section which mates with or is received within the concave shape of the spring members 118 to minimize lateral offset movement.

Furthermore, it is to be appreciated that with the preferred embodiment of the tremolo device 10 as described above, access to the clamping screws 84 for tightening and loosening of same is always provided, irrespective of the position of the fine tuning adjustment screws 94 on the fine tuning support flange 30. More particularly, it is to be noted that when one of the fine tuning adjustment screws 94 is threaded in the support flange 30 to its fullest extent, its respective rear block element 42 will be positioned so as to rest against the top surface 96 of the base plate 26. In this position, the angle of incline of the respective clamp screw 84 (relative to the surface 96 of the base plate 26) will be a minimum, i.e., the clamp screw 84 will be disposed in its lowest position. However, in that instance, the height of the fine tuning adjustment screw 94 will also be at a minimum as can best be seen in FIG. 3. An allen wrench or other tool can thus be easily inserted into the head of the clamping screw 84 to tighten or loosen the clamp block 76. Similarly, when the height of the fine tuning adjustment screws 94 is raised by unscrewing of same out of the support flange 30, the corresponding rear block element 42 will be pivoted upwardly, such that the angle of inclination of the corresponding clamp screw 84 will be at a higher extent. Again, the arrangement is such that an allen wrench or other tool may be easily inserted into the head of the clamp screw 84 to loosen and/or tighten same in connection with changing of a string 22. Thus, there is a judicious selection of the slope of the rear surface of the body portion 64 of the rear block element 42 (and, thus, the orientation of the clamping screw 84) and the configuration of the fine tuning support flange 30 to thereby ensure that the strings 22 may be clamped to the rear block element 42 with relative ease in virtually all operative positions of the various components.

It is to be appreciated that the tremolo and tuning apparatus 10 of the present invention permits both harmonic and pitch tuning of the strings 20 of the musical instrument 12. More particularly, the harmonic tuning of a string 22 is set in a conventional manner by loosening of its respective machine screws 54 and adjusting the position of the forward block element 46 on the base plate 26. In this regard, as is well known, the harmonic tuning is governed by the distance between the critical contact point provided on the nut 18 of the guitar and the critical contact point provided on the bridge 24 of the guitar, which in the tremolo device 10 of the present invention, is defined by the point at which the string makes its initial contact with the forward string support surface 78 of the rear block element 42. Once the harmonic distance is set, the strings 22 of the guitar 12 are then tuned in a conventional manner using the conventional machine heads 20. After being harmonically tuned and pitched tuned with the machine heads 20, the strings 22 are then locked at or in the vicinity of the nut 18 with the nut string clamp or locking device 17. This serves to isolate the string tension from the conventional tuning machine heads 20, and also prevents relative movement of the strings 22 over the nut 18 during actuation and subsequent release of the tremolo device 10 during play of the instrument 12. Fine adjustment of the pitch tuning of the strings 22 is thereafter accomplished with the fine tuning adjustment members 94 provided on the tremolo device 10. Specifically, by rotation of the fine tuning adjustment screws 94, the rotational position of the rear block element 42 may be changed to either increase or decrease the tension on the string 22 held by the clamping block 26. Here it should be noted that the clamping block serves to clamp the string 22 in close proximity to the critical contact point provided on the forward string support surface 78. As the string 22 is always held, there is no movement or shifting of the string 22 relative to the critical contact point during actuation of the tremolo device 10 and release of the bar 32 to return the tremolo device 10 to its inactive position.

Thus, the tremolo device of the present invention employs the features of the Floyd Rose '661 patent as well as the features of the Floyd Rose '236 patent. At the same time, however, the capability of providing a relatively low profile for the tremolo and tuning apparatus 10, such as illustrated in the preferred embodiment, is provided by virtue of the fact that the pivot arms 68 include a lower extension, namely, the rearwardly-extending leg or portion 92, which is at an elevation below the top surface 96 of the base plate 26 and, more preferably, below the bottom surface 98 of the base plate 26. It is the lower leg or extension 92 which is contacted by the fine tuning adjustment members 94 for adjusting the rotational position of the rear block element 42 and, thus, the tension on the strings 22. Since the fine tuning adjustment members 94 contact the lower leg or extension 92 of the pivot arms 68, the elevation of the adjustment members 94 relative to the overall tremolo device 10 may be significantly lower and, in the preferred embodiment, is at approximately the elevation of the strings 22. Such a low profile for the tremolo device 10 and, in particular, the fine tuning adjustment members 94, is advantageous and preferred by many musicians. Heretofore, the fine tuning adjustment screws have generally been disposed in a relatively high position (e.g., above the height of the strings) which was of less comfort to the musician and also interfered with play of the instrument, particularly when it is desired to pick very close to the bridge contact points. Also, with the prior arrangements, resting of the hand on the tremolo bridge was likely to result in slight detuning of the strings by virtue of accidentally turning the fine tuning adjustment screws. Such problems are minimized with the tremolo and tuning apparatus 10 of the present invention.

In accordance with another feature of the present invention, the fine tuning adjustment members 94 are mounted on a rearwardly-extending fine tuning support flange 30 which has a triangular-shaped cross-section. Here it should be appreciated that such a support flange 30 in accordance with the preferred embodiment is not only aesthetically pleasing in appearance, but also, is more substantial and rigid than flanges of prior tremolo bridge systems which basically merely comprise a plate section. As such, the support flange 30 of the preferred embodiment is functionally superior because there is less tendency for the flange 30 to bend or move during play of the instrument 12. In essence, due to its more rigid and substantial nature, the strings 22 will remain at the proper desired tension after having been tuned with the fine tuning adjustment members 94.

Still further, in accordance with another feature of the present invention, means 118 are provided in the tremolo and tuning apparatus 10 for minimizing lateral movement of the pivot arms 68. In the preferred embodiment, such means comprise individual spring members 118 having a concave section for contacting the lateral side edges of the pivot arms 68.

Although the invention herein has been described with reference to particular embodiments, it is to be understood that these embodiments are merely illustrative of the principles and applications of the present invention. It is therefore to be understood that numerous modifications may be made to the illustrative embodiment and that other arrangements may be devised without departing from the spirit and scope of the present invention as defined by the appended claims.

What is claimed is:

1. A tremolo and tuning apparatus for a stringed musical instrument, wherein each of the strings of the musical instrument makes a first critical contact with the instrument at a point on the nut of the instrument and a second critical contact at a point on the bridge of the instrument, the apparatus comprising:

tremolo means adapted to be mounted on the stringed musical instrument for simultaneously changing the pitch of all of the strings of the instrument, said tremolo means including a base plate having a support surface;

string support means for each of the strings rotatably mounted on said base plate and providing a string support area above said support surface;

string holding means connected to each of said string support means for holding each of the strings relative to its respective string support means;

fine tuning means associated with each of said string support means for adjusting the tension of the string held by said string holding means by rotating said string support means and said string holding means as a unit so as to fine tune the string essentially without changing the distance between said first and second critical contact points of the string; and each of said fine tuning means including a pivot arm connected to said string support means and having an extended portion which is at an elevation below said support surface of said base plate when said tremolo means is mounted on the stringed musical instrument, and adjustment means mounted on said tremolo means and engageable with said extended portion of said pivot arm for rotating said string support means.

2. The tremolo and tuning apparatus of claim 1 wherein each of said string support means includes thereon one of said first and second critical contact points for its respective string.

3. The tremolo and tuning apparatus of claim 2 wherein said string support area of each of said string support means includes said one of said critical contact points for its respective string.

4. The tremolo and tuning apparatus of claim 3 wherein said one of said critical contact points comprises said second critical contact point.

5. The tremolo and tuning apparatus of claim 3, further including means for moving each of said string support means so as to change the longitudinal distance between said first and second contact points of the strings to thereby change the harmonic tuning thereof.

6. The tremolo and tuning apparatus of claim 3 wherein there is substantially continuous contact between the string and its string support area over the distance between said one critical contact point and the point where the string is held by said string holding means.

7. The tremolo and tuning apparatus of claim 3 wherein the distance between said one critical contact point and the point where the string is held is small.

8. The tremolo and tuning apparatus of claim 3 wherein said string support area of each said string support means has a forward support portion which includes said one critical contact point and a rearward clamping portion where the string is held; and wherein said string holding means comprises a clamping block adapted to be urged against said rearward clamping portion to entrap the string between said rearward clamping area and said clamping block.

9. The tremolo and tuning apparatus of claim 8, wherein said forward support portion of said string support means is curved.

10. The tremolo and tuning apparatus of claim 8 wherein each of said string holding means further includes a clamp adjusting element for moving said clamping block toward and away from said second downward inclined surface, said clamp adjusting element being adapted to move in a direction substantially perpendicular to said second downward inclined surface.

11. The tremolo and tuning apparatus of claim 8, wherein said string support area of each of said string support means further includes a transition portion between said forward support portion and said rearward clamping portion, said transition portion including a rearward sloping surface and said rear clamping portion including a downward inclined surface.

12. The tremolo and tuning apparatus of claim 1 wherein each of said string support means is mounted on said base plate so as to be rotatable about an axis which is above said support surface of said base plate.

13. The tremolo and tuning apparatus of claim 12 wherein said axis of rotation of each of said string support means is parallel to said support surface of said base plate.

14. The tremolo and tuning apparatus of claim 12 wherein said string holding means securely holds each of the strings on its respective string support area of its respective string support means.

15. The tremolo and tuning apparatus of claim 14 wherein each of said string holding means comprises string clamping means for clamping each string to its respective string support means.

16. The tremolo and tuning apparatus of claim 15 wherein said string support area of each of said string support means includes said second critical contact point.

17. The tremolo and tuning apparatus of claim 1 wherein said tremolo means includes a fine tuning support member extending from said base plate rearwardly of said string support means when said tremolo means is mounted on the musical instrument, and wherein said adjustment means are each supported on said fine tuning support member.

18. The tremolo and tuning apparatus of claim 17, wherein said fine tuning support member has a thickness greater than the thickness of said base plate.

19. The tremolo and tuning apparatus of claim 18 wherein each of said adjustment means comprises an adjustment element supported by said fine tuning support member so as to have a first portion disposed below said fine tuning support member to engage said extended portion of said pivot arm and a second portion disposed above said fine tuning support member, said second portion of said adjustment elements being manipulable so as to adjust the position of said first portion below said fine tuning support member to thereby adjust the rotational position of said string support means.

20. The tremolo and tuning apparatus of claim 19 wherein said fine tuning support member comprises a substantially triangular-shaped support flange having a bottom surface parallel to said support surface of said base plate, a forward inclined top surface and a rearward inclined top surface; and wherein said adjustment elements are supported on said substantially triangular-shaped support flange so as to extend through said rearward inclined top surface and said bottom surface.

21. The tremolo and tuning apparatus of claim 20 wherein said support flange includes a plurality of threaded bores therethrough each extending from said rearward inclined top surface to said bottom surface; wherein each of said adjustment elements comprises a screw member supported in one of said threaded bores in said support flange; and wherein said second portion of each of said screw members comprises an enlarged, finger manipulable head.

22. The tremolo and tuning apparatus of claim 21 wherein said threaded bores of said support flange are inclined at an angle of less than 90° to the plane of said bottom surface of said support flange, and oriented so that said second portions of said adjustment elements are disposed rearwardly of said first portions of said adjustment elements.

23. The tremolo and tuning apparatus of claim 21 wherein said bottom surface of said support flange is disposed below said support surface of said base plate.

24. The tremolo and tuning apparatus of claim 23 wherein said base plate includes a bottom surface disposed at the same elevation as said bottom surface of said support flange.

25. The tremolo and tuning apparatus of claim 24 wherein said extended portions of said pivot arms are disposed at an elevation below said bottom surface of said base plate.

26. The tremolo and tuning apparatus of claim 17 wherein each of said string holding means comprise string clamping means for clamping a string to its respective string support means.

27. The tremolo and tuning apparatus of claim 26 wherein each of said string clamping means is connected to its respective string support means at an elevation above said support surface of said base plate.

28. The tremolo and tuning apparatus of claim 27 wherein each of said string clamping means includes a clamp adjusting element extending rearwardly of its respective string support means.

29. The tremolo and tuning apparatus of claim 28 wherein each of said clamp adjusting elements is oriented on said string support means so as to be accessible for adjustment along a direction which extends from said string support means to a point above said support flange.

30. The tremolo and tuning apparatus of claim 28 wherein each of said clamp adjusting elements is oriented at an angle of between 0° and 45° relative to the plane of said support surface.

31. The tremolo and tuning apparatus of claim 30, wherein each of said string clamp adjusting elements is oriented at an angle of between 10° and 30° relative to the plane of said support surface.

32. The tremolo and tuning apparatus of claim 30 wherein each of said adjustment means of said fine tuning means comprises a fine tuning adjusting element supported on said fine tuning support member at an inclined angle of between 45° and 90° relative to the plane of said support surface.

33. The tremolo and tuning apparatus of claim 32 wherein each of said fine tuning adjustment elements is supported on said fine tuning member at an angle of between 50° and 70° relative to the plane of said support surface.

34. The tremolo and tuning apparatus of claim 1 wherein said tremolo means includes a slot therethrough for each of said pivot arms disposed rearwardly of said string support means; and wherein each of said pivot arms includes a downwardly-directed portion arranged to pass through said slot and a rearward, longitudinally-extending portion which includes said extended portion engageable by said adjustment means.

35. The tremolo and tuning apparatus of claim 34 further including biasing means for biasing said longitudinally-extending portions of said pivot arms upwardly relative to said support surface of said base plate.

36. The tremolo and tuning apparatus of claim 35 wherein said biasing means comprise spring means.

37. The tremolo and tuning apparatus of claim 36 wherein said spring means includes means for maintaining the lateral position of said pivot arms relative to said base plate.

38. The tremolo and tuning apparatus of claim 37 wherein said spring means comprises a spring element for each of said pivot arms, and wherein said means for maintaining the lateral position of said pivot arms comprises a concave section of each of said spring elements for receiving and engaging lateral side portions of said longitudinally-extending portions of said pivot arms.

39. The tremolo and tuning apparatus of claim 1 wherein each of said string support means includes a first forward block and a second rear block, said second block being mounted so as to be rotatable relative to said first block and said second block including one of said first and second critical contact points thereon.

40. The tremolo and tuning apparatus of claim 39 wherein each of said second blocks is adapted to rotate about an axis parallel to said support surface of said base plate.

41. The tremolo and tuning apparatus of claim 40 wherein said first forward block of each of said string support means is movable longitudinally on said support surface of said base plate to adjust the harmonic tuning of the string supported thereon.

42. The tremolo and tuning apparatus of claim 41 wherein each of said pivot arms is integral with said second block of its respective string support means.

43. The tremolo and tuning apparatus of claim 1, further including means in the vicinity of the nut of the musical instrument for securely holding the strings of the instrument against movement relative to the nut of the instrument.

44. The tremolo and tuning apparatus of claim 1 wherein each of said string support means includes thereon said second critical contact point for its respective string, and wherein each of said string holding means securely holds its respective string against movement relative to said second contact point on said string support means.

45. The tremolo and tuning apparatus of claim 44, further including means in the vicinity of the nut of the musical instrument for securely holding the strings of the instrument against movement relative to the nut of the instrument.

46. A combination of a guitar and a tremolo and tuning apparatus, wherein each string makes a first critical contact with the guitar at a point on the nut of the guitar and a second critical contact at a point on the bridge of the guitar, the combination comprising:

a guitar comprising a guitar body portion and a guitar neck portion, and a plurality of strings, the guitar body portion having a bridge thereon and the guitar neck portion have a nut;

tremolo means mounted on the guitar for simultaneously changing the pitch of all of the strings of the instrument, said tremolo means including a base plate having a support surface;

string support means for each of said strings rotatably mounted on said base plate and providing a string support area above said support surface;

string holding means connected to each of said string support means for holding each of said strings relative to its respective string support means;

fine tuning means associated with each of said string support means for adjusting the tension of said string held by said string holding means by rotating said string support means and said string holding means as a unit so as to fine tune said string essentially without changing the distance between said first and second critical contact points of said string; and each of said fine tuning means including a pivot arm connected to said string support means and having an extended portion which is at an elevation below said support surface of said base plate, and adjustment means mounted on said tremolo means and engageable with said extended portion of said pivot arm for rotating said string support means.

47. The combination of claim 46 wherein said string support area of each of said string support means includes one of said critical contact points for its respective string.

48. The combination of claim 47 further including means for moving each of said string support means so as to change the longitudinal distance between said first and second contact points of each of said strings to thereby change the harmonic tuning thereof.

49. The combination of claim 47 wherein said string support area of each said string support means has a forward support portion which includes said one critical contact point and a rearward clamping portion where the string is held; and wherein said string holding means comprises a clamping block adapted to be urged against said rearward clamping portion to entrap the string between said rearward clamping area and said clamping block.

50. The combination of claim 46 wherein each of said string support means is mounted on said base plate so as to be rotatable about an axis which is above said support surface of said base plate.

51. The combination of claim 50 wherein said axis of rotation of each of said string support means is parallel to said support surface of said base plate.

52. The combination of claim 50 wherein said string holding means securely holds each of said strings on its respective string support area of its respective string support means.

53. The combination of claim 52 wherein each of said string holding means comprises string clamping means for clamping said string to its respective string support means.

54. The combination of claim 46 wherein said tremolo means includes a fine tuning support member extending from said base plate rearwardly of said string support means when said tremolo means is mounted on said guitar, said fine tuning support member having a thickness greater than the thickness of said base plate; and wherein said adjustment means are each supported on said fine tuning support member.

55. The combination of claim 54 wherein said fine tuning support member comprises a substantially triangular-shaped support flange having a bottom surface parallel to said support surface of said base plate, a forward inclined top surface and a rearward inclined top surface; and wherein said adjustment means each comprise an adjustment element supported on said substantially triangular-shaped support flange so as to extend through said rearward inclined top surface and said bottom surface.

56. The combination of claim 46 wherein each of said string support means includes a first forward block and a second rear block, said second block being mounted so as to be rotatable relative to said first block and said second block including one of said first and second critical contact points thereon.

57. The combination of claim 56 wherein said first forward block of each of said string support means is movable longitudinally on said support surface of said base plate to adjust the harmonic tuning of the string supported thereon.

58. The combination of claim 46, further including means in the vicinity of said nut of said guitar for securely holding said strings of said guitar against movement relative to said nut.

59. The combination of claim 46, wherein each of said string support means includes thereon said second critical contact point for its respective string, and wherein each of said string holding means securely holds its respecting string against movement relative to said second critical contact point on said string support means.

60. The combination of claim 59, further including means in the vicinity of said nut of said guitar for securely holding said strings of said guitar against movement relative to said nut.

* * * * *